US012758035B2

(12) United States Patent
Puckerin

(10) Patent No.: US 12,758,035 B2
(45) Date of Patent: Oct. 13, 2026

(54) SWADDLE PILLOW

(71) Applicant: Maureen Puckerin, Kissimmee, FL (US)

(72) Inventor: Maureen Puckerin, Kissimmee, FL (US)

( * ) Notice: Subject to any disclaimer, the term of this patent is extended or adjusted under 35 U.S.C. 154(b) by 0 days.

(21) Appl. No.: 19/076,660

(22) Filed: Mar. 11, 2025

(65) Prior Publication Data

US 2025/0288126 A1 Sep. 18, 2025

Related U.S. Application Data

(60) Provisional application No. 63/564,615, filed on Mar. 13, 2024.

(51) Int. Cl.
*A47D 15/00* (2006.01)

(52) U.S. Cl.
CPC ..... *A47D 15/008* (2013.01); *A47D 15/001* (2013.01)

(58) Field of Classification Search
CPC .. A47D 15/008; A47D 15/001; A47D 15/005; A47D 13/08; A47D 9/00; A47D 13/083; A47D 15/003; A47D 15/00; A47D 13/00; A47D 5/00; A47D 5/006; A41B 13/06; A41B 13/065; A41B 2500/10; A47G 9/1045; A47G 9/02; A47G 9/10; A47G 2009/1018; A47G 9/06
USPC ..... 5/655, 494, 482, 498, 603, 95; 2/69.5, 2/83, 243.1, 69, 75, 80
See application file for complete search history.

(56) References Cited

U.S. PATENT DOCUMENTS

| | | | | |
|---|---|---|---|---|
| 5,722,094 | A | 3/1998 | Reufer | |
| 8,782,831 | B2 | 7/2014 | Houston et al. | |
| 9,131,734 | B2 | 9/2015 | Daugherty et al. | |
| 9,332,791 | B1 * | 5/2016 | Bush | A47D 15/003 |
| 9,380,896 | B2 | 7/2016 | Carangelo | |
| 9,820,907 | B1 | 11/2017 | Bush et al. | |
| 2014/0298587 | A1 * | 10/2014 | Sedivy | A41D 11/00 5/655 |
| 2015/0101101 | A1 * | 4/2015 | Gotel | A41B 13/065 2/69.5 |
| 2015/0121627 | A1 * | 5/2015 | O'Donnell | A41D 1/215 5/639 |
| 2016/0135612 | A1 * | 5/2016 | Morton | A47D 15/008 5/424 |
| 2017/0318865 | A1 * | 11/2017 | Karnati | A47D 13/08 |
| 2020/0345159 | A1 * | 11/2020 | Mighali | A47G 9/083 |

FOREIGN PATENT DOCUMENTS

| | | | | |
|---|---|---|---|---|
| KR | 20200078206 A | * | 7/2020 | D06B 3/10 |
| KR | 102333449 B1 | * | 12/2021 | A47D 15/00 |
| KR | 102974319 B1 | * | 6/2026 | A41B 13/06 |

* cited by examiner

*Primary Examiner* — Madison Matthews
(74) *Attorney, Agent, or Firm* — The Concept Law Group, PA; Scott D. Smiley; Scott M. Garrett

(57) ABSTRACT

A swaddle pillow includes a pillow body having a depression formed into the pillow body at a front of the pillow body. The depression is configured to receive an infant or baby therein, and includes a head section and a body section. A cover is provided over the body section of the protrusion to keep the infant/baby warm, as well as too provide swaddle material that can be lightly compressed towards the infant/baby by one or more swaddle straps.

17 Claims, 15 Drawing Sheets

1100

SWADDLE PILLOW

CROSS-REFERENCE TO RELATED APPLICATION

This application claims priority to U.S. Provisional Patent Application No. 63/564,615 filed Mar. 13, 2024, the entirety of which is incorporated by reference.

FIELD OF THE INVENTION

The present invention relates generally to infant swaddles, and, more particularly, relates to a swaddle pillow to safely hold an infant.

BACKGROUND OF THE INVENTION

A swaddle is used to wrap or clothe infants that are newborn to about 6 months old. The wrap provides a soft structure both keeps the infant warm and provide them a safe, secure feeling that resembles being in the womb. However, swaddling can be done improperly. Overly tight swaddling can lead to joint and hip issues, such as hip dysplasia. In other circumstances tight swaddling can restrict breathing. Swaddling with heavy blankets can cause overheating, which is a known risk factor for sudden infant death syndrome (SIDS). Swaddling that is too loose can result in fabric obstructing the infants breathing, or simply coming loose and exposing the infant to cool air.

Therefore, a need exists t overcome the problems with the prior art as discussed above.

SUMMARY OF THE INVENTION

In accordance with some embodiments of the inventive disclosure, there is provided a s pillow that includes a pillow body having a head end and a foot end. There is a depression formed in the pillow body that starts adjacent the head end and extends towards the foot end. The depression, adjacent the head end, is sized to receive a head of an infant. There is also a cover or case that extends over a torso portion of the pillow body and forms a pouch.

In accordance with a further feature, the cover is attached to a front of the pillow body.

In accordance with a further feature, the cover is a pouch cover, and wherein the torso portion of the pillow body fits within a pouch opening of the pouch cover.

In accordance with a further feature, there is further included at least one elastic swaddle strap having a fixed end that is connected to the cover at a side of the swaddle pillow.

In accordance with a further feature, the at least one elastic swaddle strap further comprises a free end, and there is a section of book and loop fastening material disposed at the free end, and there is a mating section of hook and loop fastening material at the fixed end, and at least one elastic swaddling strap is configured to wrap around an entirety of the swaddle pillow such that the section of book and loop fastening material disposed at the free end mates with the mating section of book and loop fastening material at the fixed end.

In accordance with a further feature, the depression extends to the foot end of the pillow body.

In accordance with a further feature, the swaddle pillow further comprises decoration that includes a simulated animal tail, wherein an end of the simulated animal tail is configured to hold a pacifier.

In accordance with a further feature, the pillow body around the depression, is a consistent thickness from a front of the pillow body to a back of the pillow body.

In accordance with a further feature, the depression extends to a position adjacent the foot end of the pillow body, and wherein the depression widens, from a head section to a torso section, to accommodate a shoulder area of the infant.

In accordance with a further feature, the head portion of the pillow body is thicker, from a front of the pillow body to a back of the pillow body, than the torso portion, and wherein the depression does not extend into the torso portion of the pillow body.

In accordance with some embodiments of the inventive disclosure, there is provided a swaddle pillow for an infant that includes a pillow having a head end and a torso portion adjacent the head end centrally along a length of the pillow. There is a head recess sewn into the pillow at the head end, and a torso recess sewn into the pillow along the torso portion. There is a case configured to fit over the pillow, and a flap attached at an end of the case which forms a pouch over the torso portion when the flap is folded over the pillow.

Although the invention is illustrated and described herein as embodied in a swaddle pillow, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are closed herein; however, it is to be understood that the disclosed embodiments are merely exemplary of the invention; which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is nor intended to be limiting. The terms "a" or "an," as used herein, are defined as one or more than one. The term "plurality," as used herein, is defined as two or more than two. The term "another," as used herein, is defined as at least a second or more. The terms "including" and/or "having." as used herein, are defined as comprising (i.e., open language). The term "coupled." as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down," "left," "right," "inside," "outside," "front," "back," "head," "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first," "second," "third," and so on are only used for descriptive purposes and cannot be construed as indicating or implying relative importance.

In the description of the embodiments of the present invention, it should be noted that, unless otherwise clearly defined and limited, terms such as "installed," "coupled." "connected" should be broadly interpreted, for example, it may be fixedly connected, or may be detachably connected, or integrally connected; is may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function of result). In many instances, these terms may include numbers that are rounded to the nearest significant figure. In this document, the term "longitudinal" should be understood to mean in a direction corresponding to an elongated direction of the article being referenced. Those skilled in the art can understand the specific meanings of the above-mentioned terms in the embodiments of the present invention according to the specific circumstances. The term "extends" is intended to indicate any of a length, width, or height of an element being described. The term "extends from" is intended to mean that the element being described is adjacent to, of connected or coupled to another element, and the element being described reaches outward from there. For example, a bridge extends from one river bank, over the river, to the opposite river bank. The bridge isn't performing an action, rather, the term describes a dimensional quality of the bridge, which is the bridge is long enough to reach from one river bank to the opposite river bank.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require as least one of X, at least one of Y, and at least one of Z to each be present.

BRIEF DESCRIPTION OF THE DRAWINGS

The accompanying figures, where like reference numerals refer to identical or functionally similar elements throughout the separate views and which together with the detailed description below are incorporated in and form part of the specification to further illustrate various embodiments and explain various principles and advantages all in accordance with the present invention.

DETAILED DESCRIPTION

Figure 1:
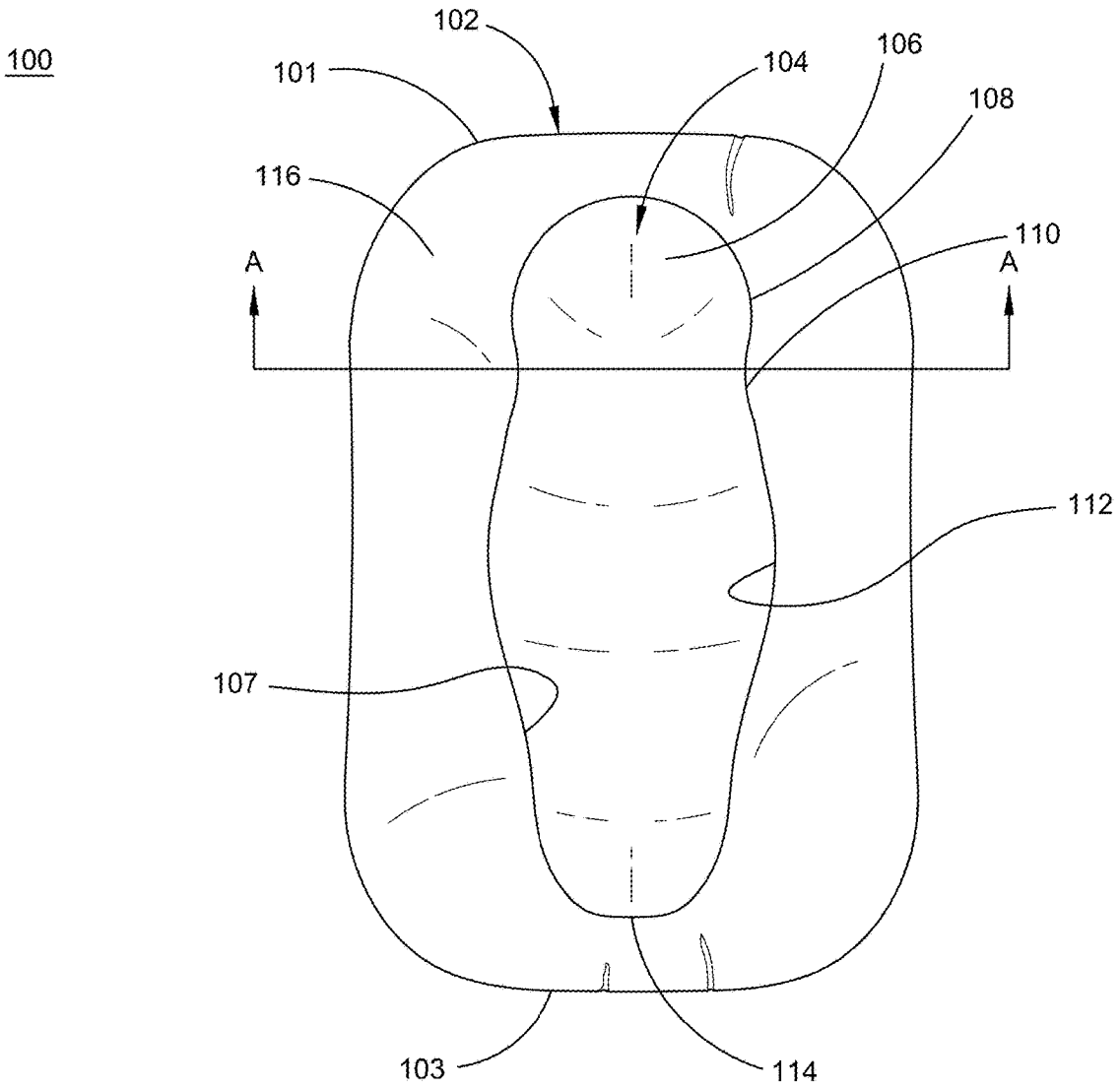
FIG. 1 shows a top plan view of a swaddle pillow, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 shows a top plan view of a swaddle pillow 100, in accordance with some embodiments. The swaddle pillow 100 holds an infant in an enveloping manner that tends to restrict the infant's movement in order to provide support to the infant, as well as comfort. Swaddling involves wrapping a thin cloth blanket around an infant to cover the infant body. It is believed that this practice mimics the environment of the womb, and helps some infants to relax and sleep better, as it can limit the startle reflex, which might otherwise wake the infant. Swaddling also helps keep an infant in a supine position, which can lower the risk of sudden infant death syndrome (SIDS). Typically, swaddling is used until the infant is about 2 months, when the infant shows signs of trying to roll over on their own. The inventive swaddle pillow provides a swaddling effect while ensuring that the swaddling isn't too tight, too loose, result in loose ends, or any of the other problems associated with traditional swaddling.

The swaddle pillow includes pillow body 102 that has a head end 101 and a foot end 103. There is a depression 104 into the pillow body from the front surface 116 toward the back surface (118 in FIG. 2). The depression 104 is a void of material into which an infant, of portion of an infant (e.g. the head of the infant) can be positioned. Because the depression 104 extends into the pillow body 102, it creates a wall 107 around the depression 104 that can snugly hold the infant. The depression 104 includes head portion 108 in which a portion 106 of the depression 104 is configured (e.g. sized) to receive the head of the infant. The depression 104 widens from the head portion 108 to the shoulder portion 110 to accommodate the infant's shoulders. The body portion 112 extends to the foot portion 114 in this example, and is configured to snugly hold the infant's body. The pillow body 102 can be covered with fabric, and the interior of the pillow body can be filled with any number of conventional pillow fillings, including, for example, cotton or foam. The depression 104 can formed into the material of the pillow body 102 by removing material from the region of the depression 104. In cases where the pillow body 102 is made of foam, the depression 104 can be molded into the foam. In cases where the pillow body 102 is filled with, for example, cotton, then the covering of the pillow body 102 can be sewn to create the depression 104.

Figure 2:
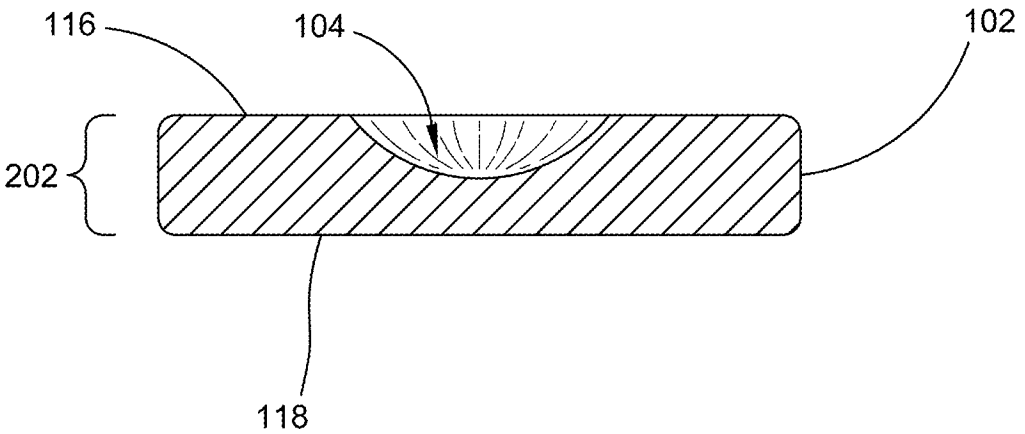
FIG. 2 shows a side section view of a swaddle pillow taken along line AA of FIG. 1.

FIG. 2 shows a side section view of a swaddle pillow taken along line AA of FIG. 1. Here, the depression 104 can be seen formed into the pillow body 102 at the front 116 towards the back 118. The height 202 of the pillow body, at least at the head region, can be on the order of one to four inches in some embodiments, and it can be more or less in other embodiments. The depth of the depression 104 from the front 116 will be less than the height 202 of the pillow body.

Figure 3A:
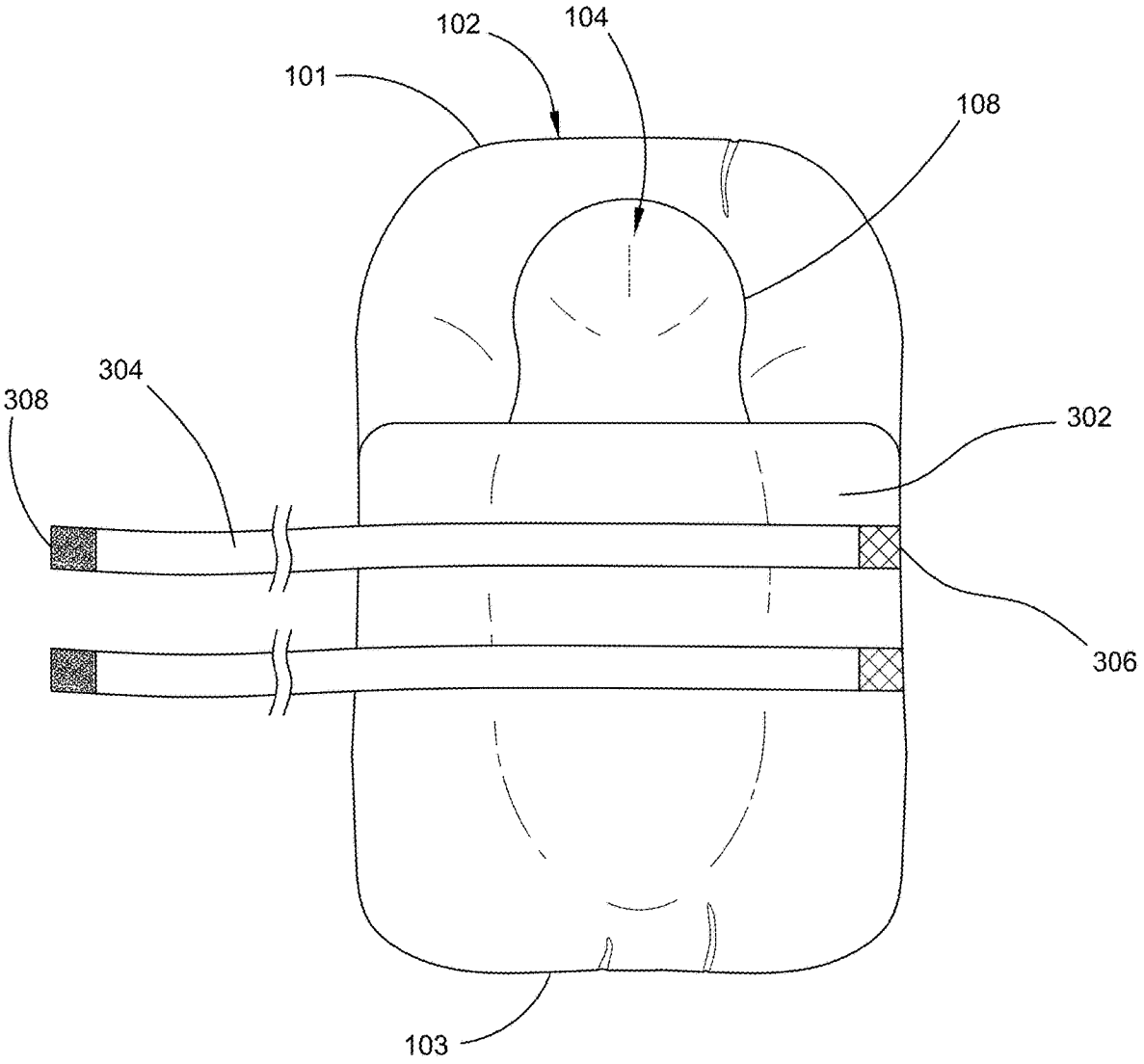
FIG. 3A shows a top plan view of a swaddle pillow with a cover and swaddling straps, in accordance with some embodiments.
Figure 3B:
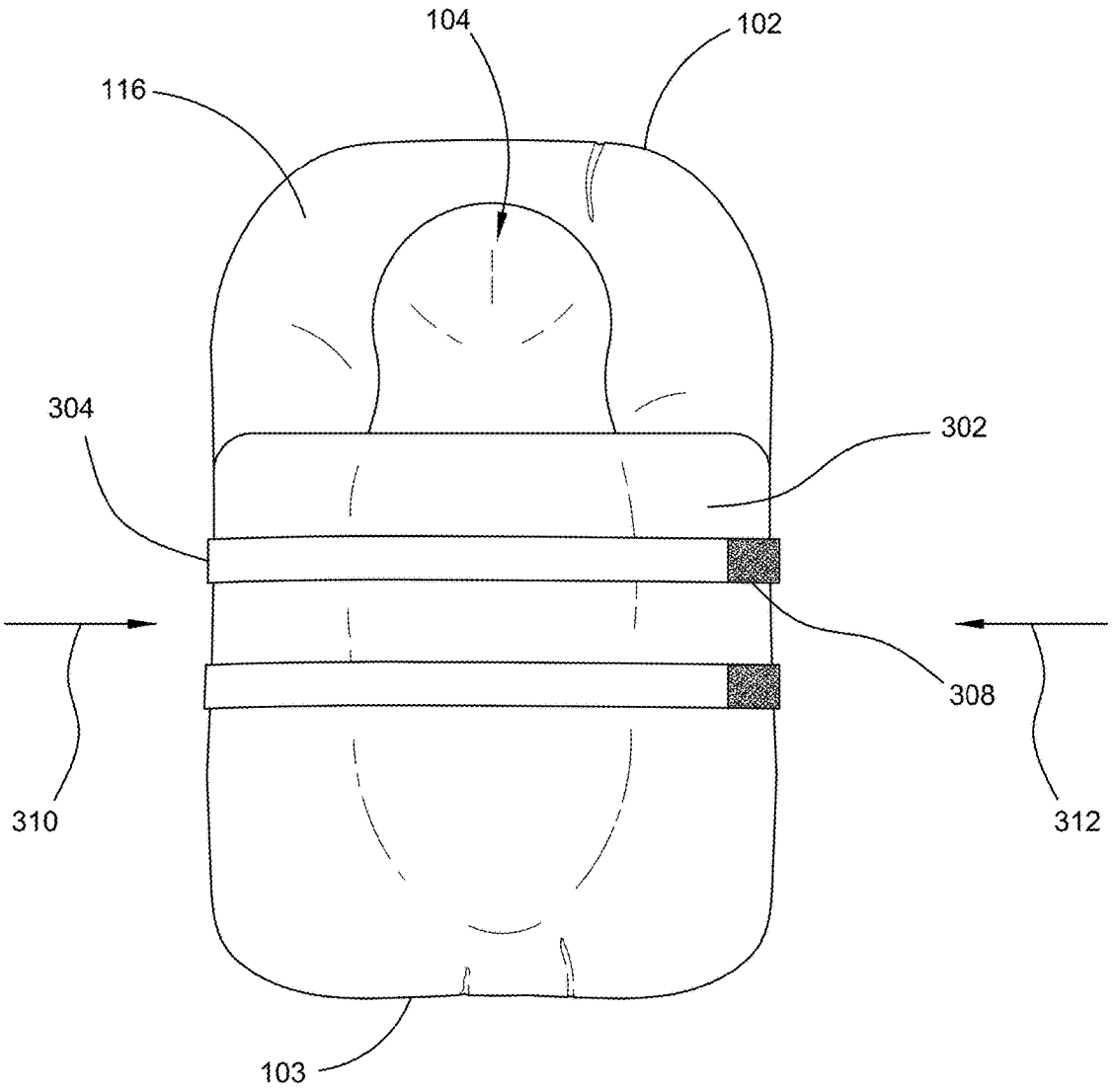
FIG. 3B shows a top plan view of the swaddle pillow with the swaddle straps drawn around the swaddle pillow body, in accordance with some embodiments.

FIG. 3A shows a top plan view of a swaddle pillow 100 with a cover 302 and swaddle straps 304, in accordance with some embodiments. The cover 302 either fits over the pillow body 102 from the foot end 101 toward the head end 101, or the cover 302 attached to the pillow body 102 over the same region of the pillow body 102. In particular, the cover 302 cover the body portion 112 of the depression 104, but not the head portion 108 of the depression 104. The swaddle straps 304 are elastic lands that can have fixed end 306 and a free end 308. At each of the fixed end 306 and free end 308 there is a section or portion of hook and loop material that mates with the complementary portion of hook and loop material (i.e, hook is complementary to loop and vice versa) as the other end 306, 308. The swaddle bands 304 are generally centrally located between the head end 101 and the foot end 103, at about the position where the upper torso of the infant would be when the infant is placed in the depression 104. In use, the swaddle bands 304 are slightly stretched, and wrapped around the pillow body so that the free end 308 meets the fixed 306. The hook and loop section make closing and opening the connection between the fixed end 306 and the free end 308 convenient, but other means of coupling the ends together can also be used, such as a button and button hole, a clasp, and so on. In FIG. 3B the swaddle bands 304 are show closed, where the free end 308 is coupled to the fixed end. As a result, there is some inward compression at the sides of the pillow body 102, and indicted by arrows 310, 312. There is also compression in de direction from the front 116 to the back 118 (e.g. in FIG. 2). The side compression in the direction of the arrows 310, 312 can help support the shape of the pillow body, and specifically the depression 104. In some embodiments there can be a single swaddle band 304, and in other embodiments there can be multiple swaddle bands 304, which allows the user to adjust the compression at specific location corresponding to the position of the swaddle band along the side of the pillow body. That is, there can be a swaddle band 304 intended to go around the pillow body 102 at the location of the infant's upper torso, and there can be one positioned to go around the pillow body 102 at the location of the infant's abdomen. It is also contemplated that the swaddle bands can be different lengths, and that the bands can be changed swap out bands of different lengths to achieve desired compressive effect for different sized infants.

Figure 4:
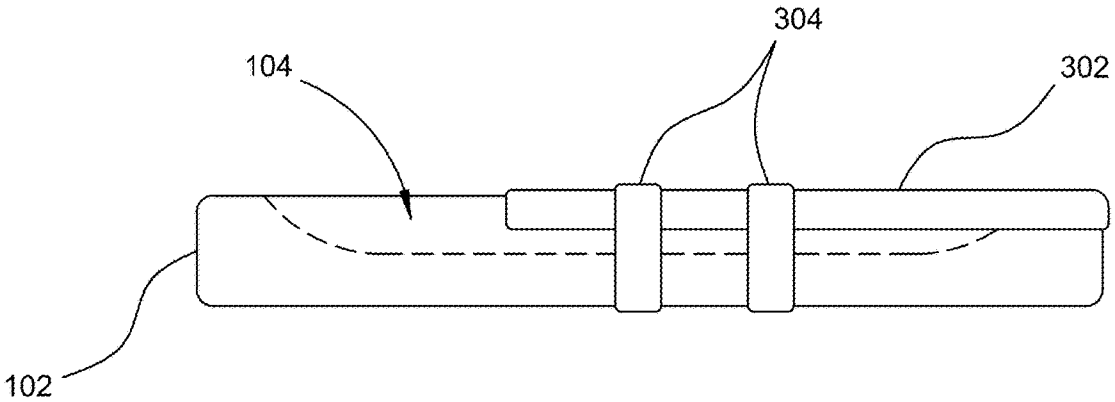
FIG. 4 is a side view of a swaddle pillow having a top cover, in accordance with some embodiments.
Figure 5:
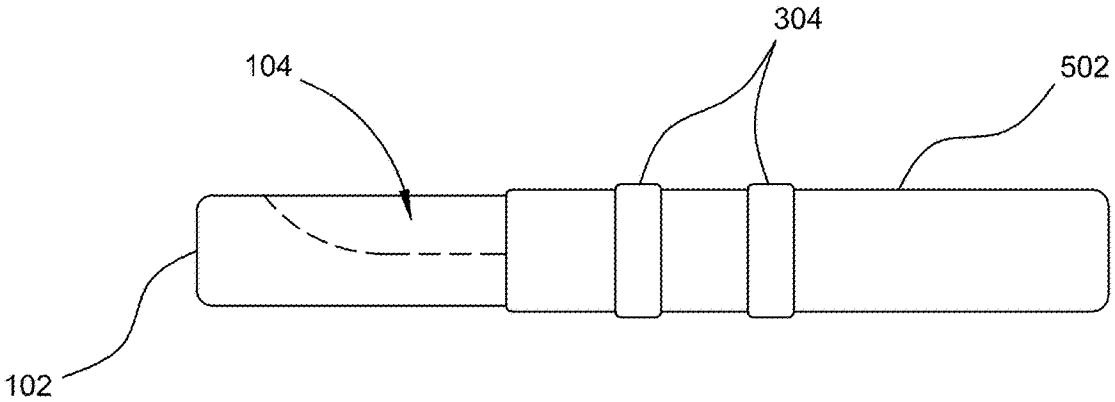
FIG. 5 shows a side view of a swaddle pillow having a pouch cover, in accordance with some embodiments.

FIG. 4 is a side view of a swaddle pillow having a top cover 302, and FIG. 5 shows a side view of a swaddle pillow having a pouch cover 502, in accordance with some embodiments. In FIG. 4, the cover 302 can be directly attached to the pillow body, either permanently, or removably, and the cover 302 has a width that substantially covers the width of the front of the pillow body 102. The bottom contour of the depression 104 is indicated here by broken line, indicating that the depression is a concave void into the pillow body, and covered, partially, but the cover 302. In FIG. 5, the cover is a pouch cover 502 into which all but the head portion of the pillow body 102 is inserted. It is noted that the swaddle straps 304 are shown in the wrapped state in these drawings.

Figure 6:
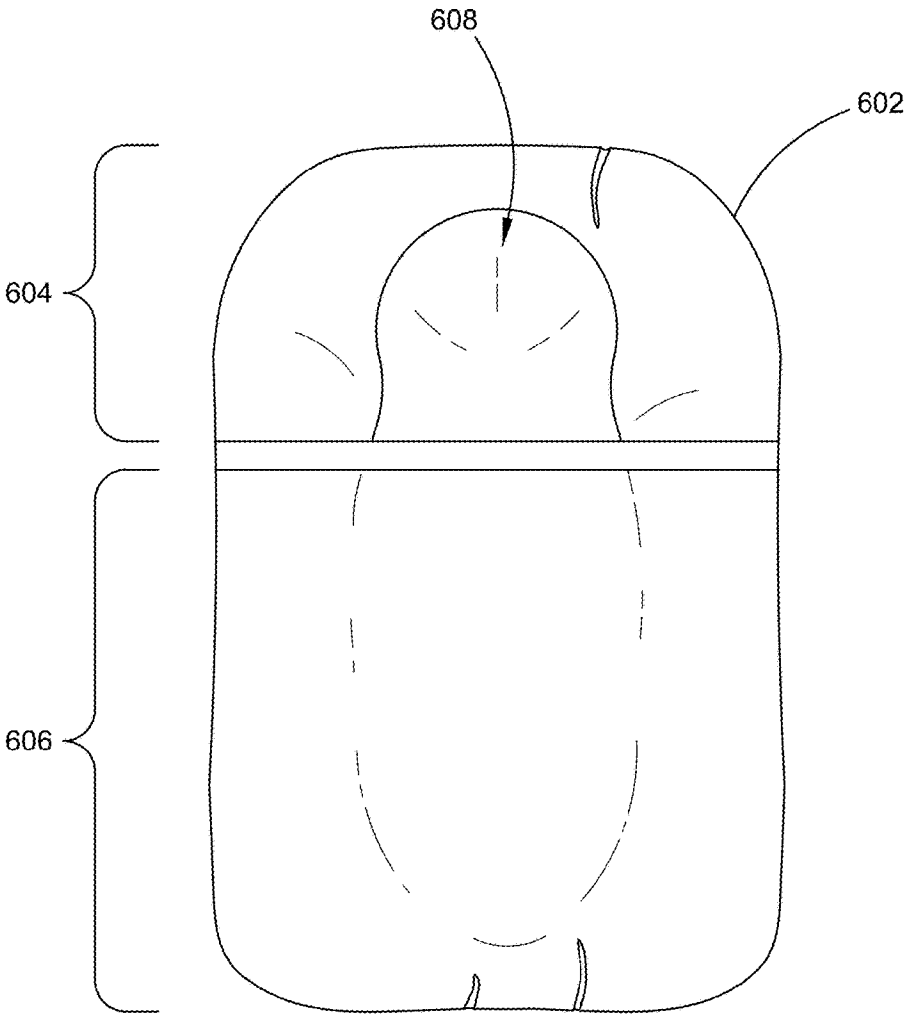
FIG. 6 shows a top plan view of a swaddle pillow body in which the head section includes a depression, and the torso portion of the pillow body is flat, in accordance with some embodiments.
Figure 7:
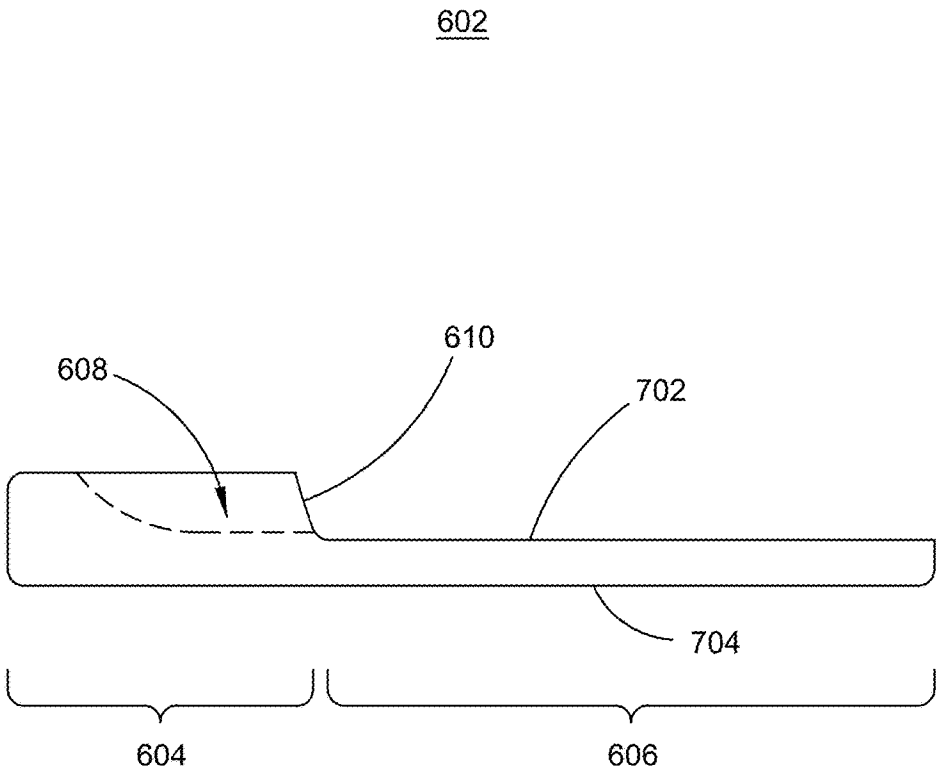
FIG. 7 shows a side view of a swaddle pillow body in which the head portion and torso portion have different thicknesses, and the head portion includes a depression to accommodate an infant's head, in accordance with some embodiments.
Figure 8:
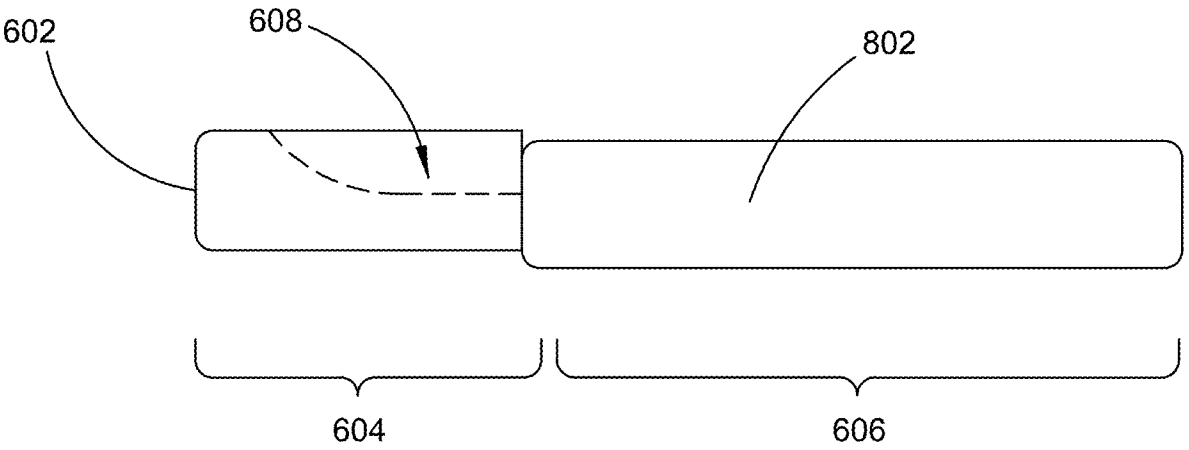
FIG. 8 shows a side view of a swaddle pillow including a cover, in accordance with some embodiments.

FIG. 6 shows a top plan view of a swaddle pillow body 602 in which the head section 604 includes a depression 608, and the torso section 606 of the pillow body 602 is flat, in accordance with some embodiments. In this alternative embodiment, the depression 608 in the head section 604 constrains the infant's head, while the torso section 604 allows for some body and limb movement, which can aid, for example, with mobility development. The torso section 606 supports both the infant's torso, as well as lower body and legs. FIG. 7 shows a side view of the swaddle pillow body 602, and it can be seen that the head section 604 and torso section 606 have different thicknesses. The head section includes the depression 608 to accommodate an infant's head. The depression 608 can be formed into the head section 604 to a depth such that the depression 608 and the front 702 of the torso section 606 at the same height relative to the back 704 of the pillow body 602. FIG. shows a side view of the swaddle pillow body 602 including a cover 802, which is a pouch cover, in which the torso section 604 inserted. The infant can be placed on the pillow body 602 with the infants head rested in the depression 608, and the rest of the infant's body on the front 702 of the torso section 606. Then the cover 802 can be placed over the infant's body and the torso section 606, leaving the infant's head exposed in the head section 604, but gently constrained in the depression 608. Swaddle straps (e.g. 304) can then be wrapped around the entirety of the swaddle pillow to produce a desired level of swaddling compression to mitigate startle, or permit more mobility, as needed.

Figure 9:
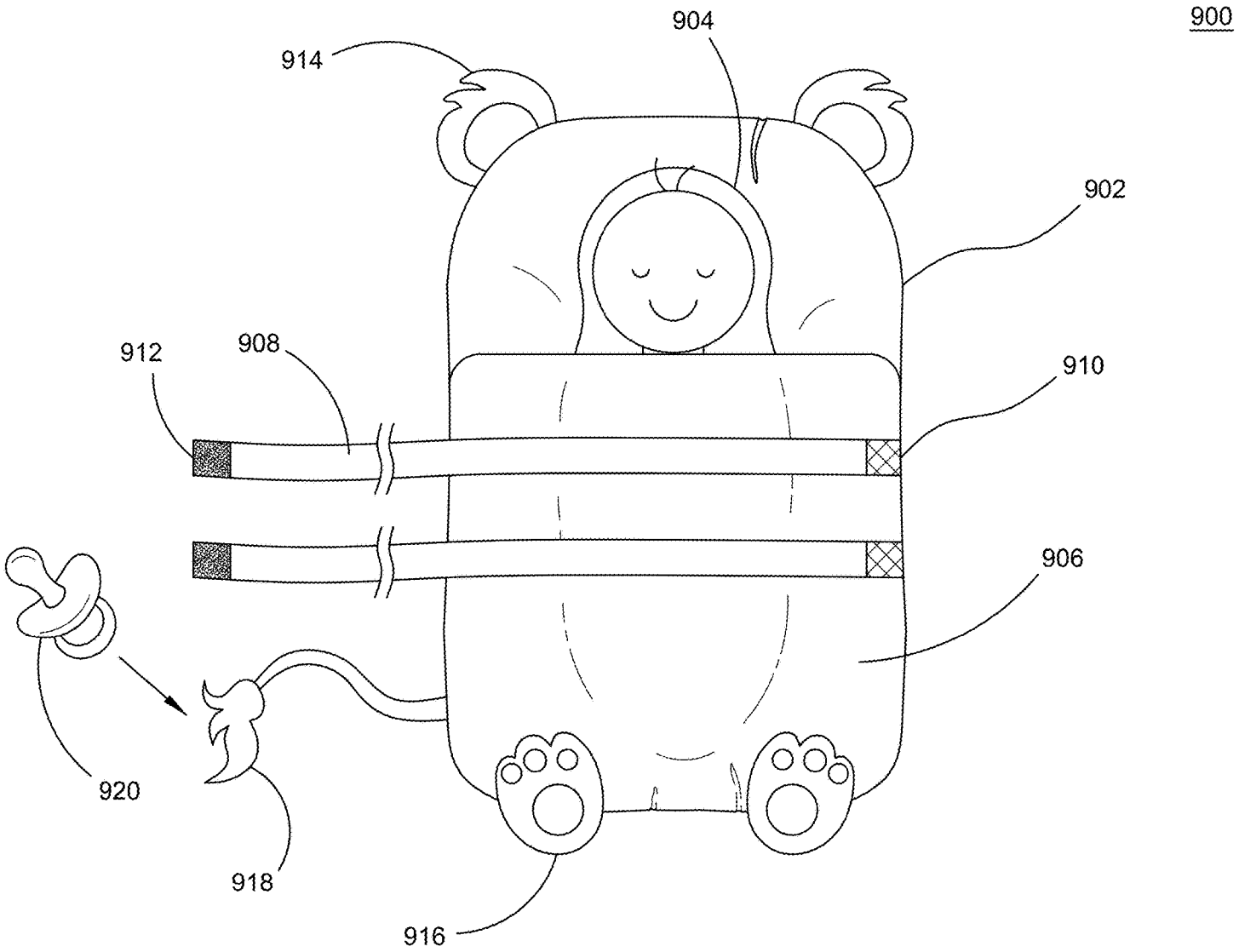
FIG. 9 shows a top plan view of swaddle pillow that is decorated with animal features, in accordance with some embodiments.

FIG. 9 shows a top plan view of swaddle pillow 900 that is decorated with animal features 914, 916, in accordance with some embodiments. The swaddle pillow 900 includes a pillow body 902 that includes a depression 904 formed into the front of the pillow body 902. The depression 904 is a generally concave void of material formed into the pillow body 902 at the front of the pillow body 902, and that is sized to receive and hold an infant therein. A cover 906 is disposed over the pillow body, and is configured to cover the infant's body from the neck down. The cover 906 can envelop a large portion of the pillow body 902. Swaddle straps 908 are provided with mating fasteners at a fixed end 910 that is coupled to the cover, and a free end 912. The swaddle straps can be wrapped around the pillow body 902 and cover 906 to provide a slight compressive, inward force entirely around the infant. A pacifier 920 can be coupled to the end of a simulated tail of similar length of material. A "tail" work well because the tail is attached at a position far away from the infant's head, and if the length of the tail is properly selected, it eliminates the chance the tail becoming wrapped around the infant.

Figure 10A:
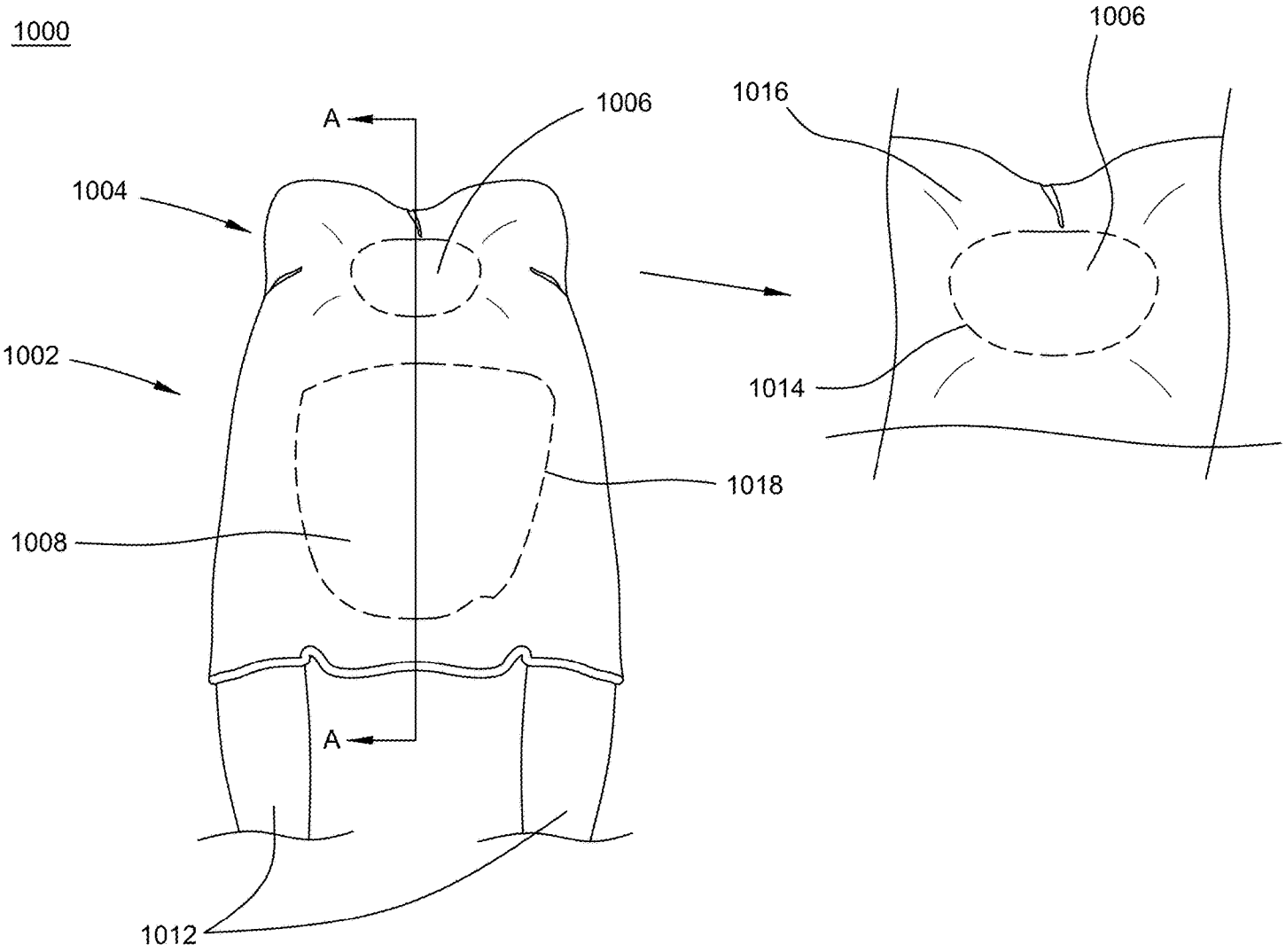
FIG. 10A shows a swaddle pillow without a case, to reveal stitching detail that provided contour on the swaddle pillow, in accordance with some embodiments.
Figure 10B:
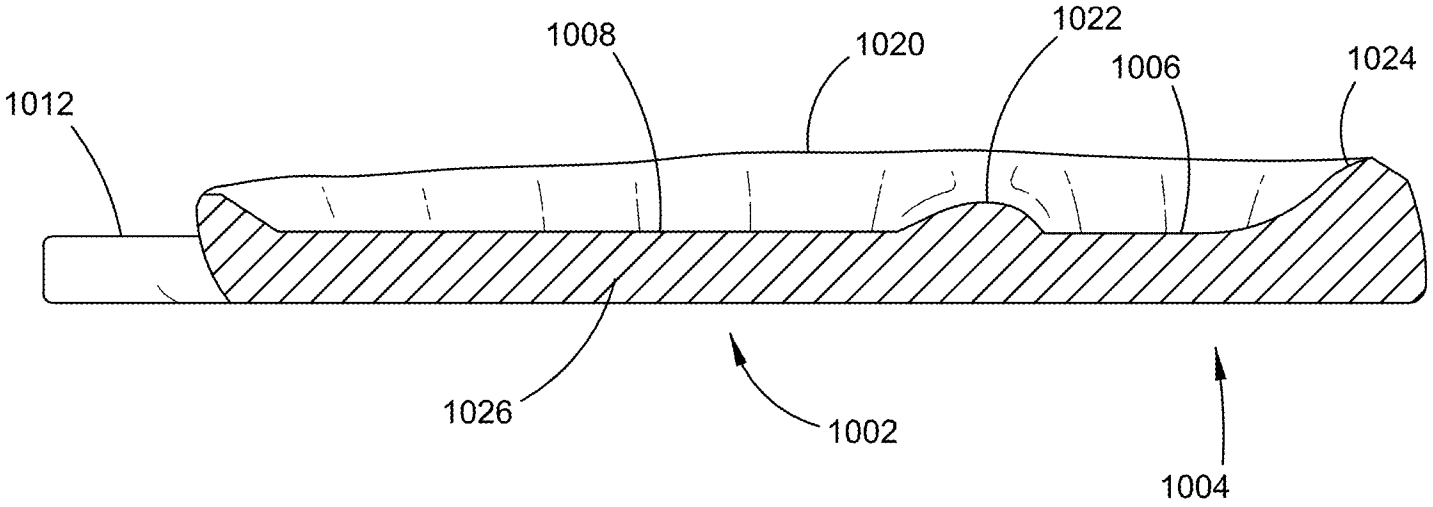
FIG. 10B shows a side section view of the swaddle pillow of FIG. 10A, taken along line A-A.
Figure 11:
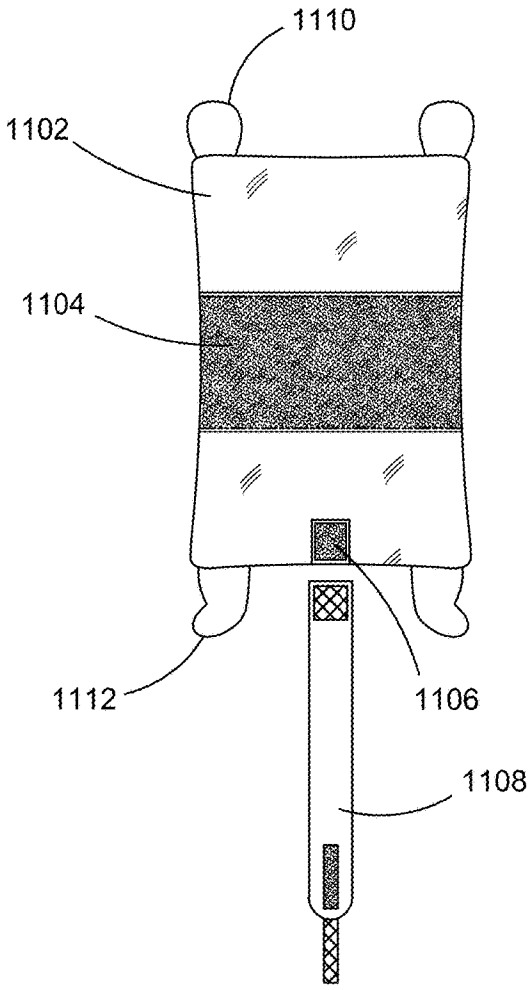
FIG. 11 shows a rear view of a swaddle pillow including a case that has attachment features, in accordance with some embodiments.

FIG. 10A shows a swaddle pillow 100 without a case, to reveal stitching detail that provides contours on the swaddle pillow, in accordance with some embodiments. The pillow body 1000 includes a torso portion 1002 and a bead portion 1004. The head portion 1004 is at a head end of the pillow body 1000. The torso portion 1002 is central to the pillow body 1000 and extends in a direction along the length of the pillow, from the head end. A head recess 1006 is formed in the head portion 1004 at the head end by stitching 1014 around the head recess 1006, which prevents the pillow stuffing material from gathering under the region defined by the stitching 1014 around the head recess 1006. Similarly, there is a body depression 1008 formed in the torso portion 1002 that is defined by stitching 1018. The pillow body 1000 can have feet portion 1012 that extend from a foot end of the pillow body 1000. FIG. 10B shows a side cutaway view of the swaddle pillow of FIG. 10A, taken along line A-A, and shows the internal portion of the pillow, including the stuffing material 1026. The head recess 1006 and the body recess 1008 can be separated by a raised neck area 1022. Likewise, the border 1020 of the pillow body 1000 around the head depression 1006 and the body depression 1008 is raised, substantially more than the neck area 1022. The border 1020 extends around the perimeter of the pillow body 1000, surrounding the head depression 1006 and the body depression 1008 jointly, and creates an inclined portion, such as inclined portion 1024, around the depressions 1006, 1008 that help secure the infant in the swaddle pillow by providing s soft, raised border 1020 around the infant when the infant is in the swaddle pillow. The border 1020 around the depressions 1006, 1008 provide side support around the infant, and prevent the infant from rolling to the side. The raised border 1020 can surround the depressions 1006, 1008 entirely in some embodiments, and in some embodiments, for example, the raised border may not be present at the foot end of the pillow body 1000.

Figure 13:
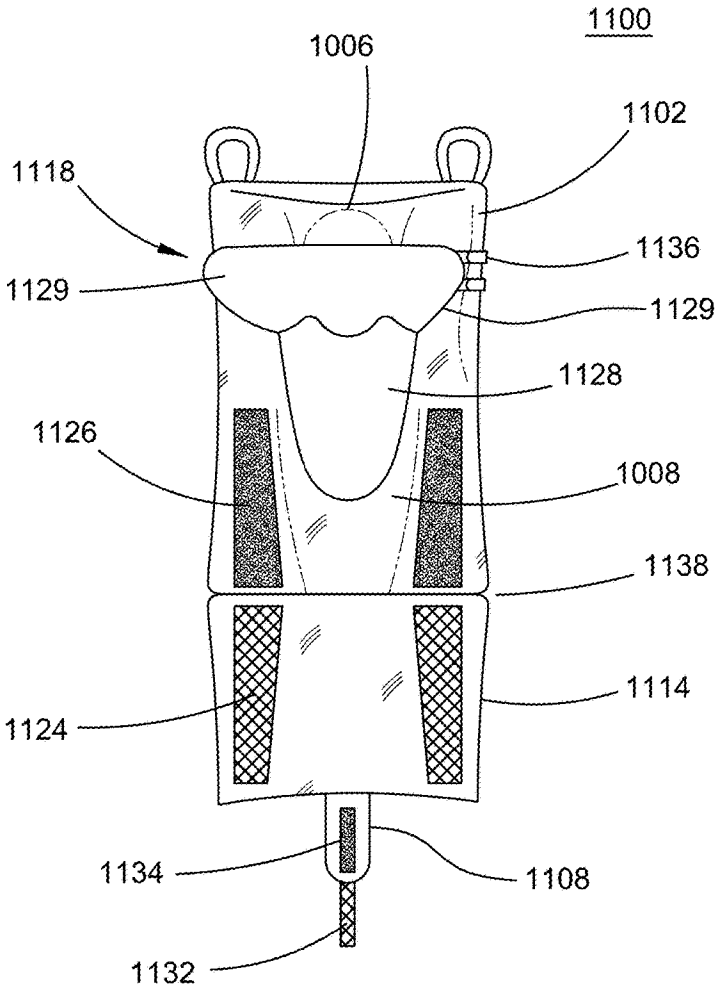
FIG. 13 shows a front view of a swaddle pillow with the pouch open, and including an attached swaddle, in accordance with some embodiments.
Figure 12:
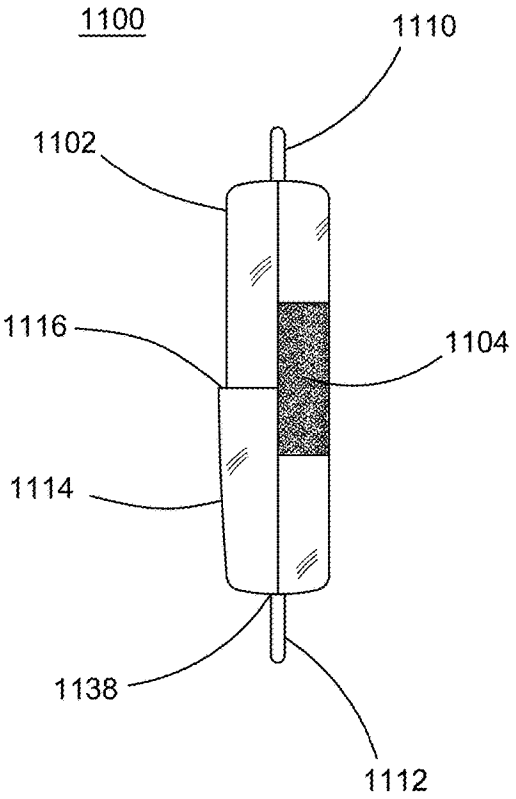
FIG. 12 shows a side view of a swaddle pillow with a case indicating a pouch at a front of the swaddle pillow formed by the case, in accordance with some embodiments.

FIGS. 11-16 show an example of a swaddle pillow 1100 including a case 1102 that forms a pouch. The case 1102 is a fabric cover sized to fit over the pillow (e.g. 1000). FIG. 1/ shows a rear view of the swaddle pillow 1100 including a case 1102 that has attachment features, such as a portion of book and loop fastener material 1104 at about the middle of the rear of the swaddle pillow 1100, on the case 1102. A smaller portion of hook and loop material 1106 can be positioned at the foot end of the swaddle pillow 1100 so that a mock tail 1108 is configured to couple to the case and can be removably attached to the case 1102. The tail 1108, as shown in FIG. 13, and include complementary portions 1132, 1134 of hook and loop fastener that forms a loop that can be used to retain, for example, a pacifier. The case 1102 can also have mock cars 1110 and feet/legs 1112 attached at opposite end of the case 1102. In FIG. 12, the hook and loop fastener material 1104 can be seen at the back side of the case 1102. At the front side of the case 1102, there is a flap 1114 that's used to form a pouch over the body portion of the pillow, with a top edge 1116 at about the middle of the pillow 1100 in a direction along the length of the pillow 1100. In FIG. 13 the Gap 1114 is open, exposing sections of interlocking hook and loop material on the inside of the flap 1114, at 1124, and on the main portion of the case 1102, at 1126. The flap 1114 is attached to the case 1102 along a hem 1138 joining the bottom of the flap 1114 to the foot end of the case 1102.

Figure 14:
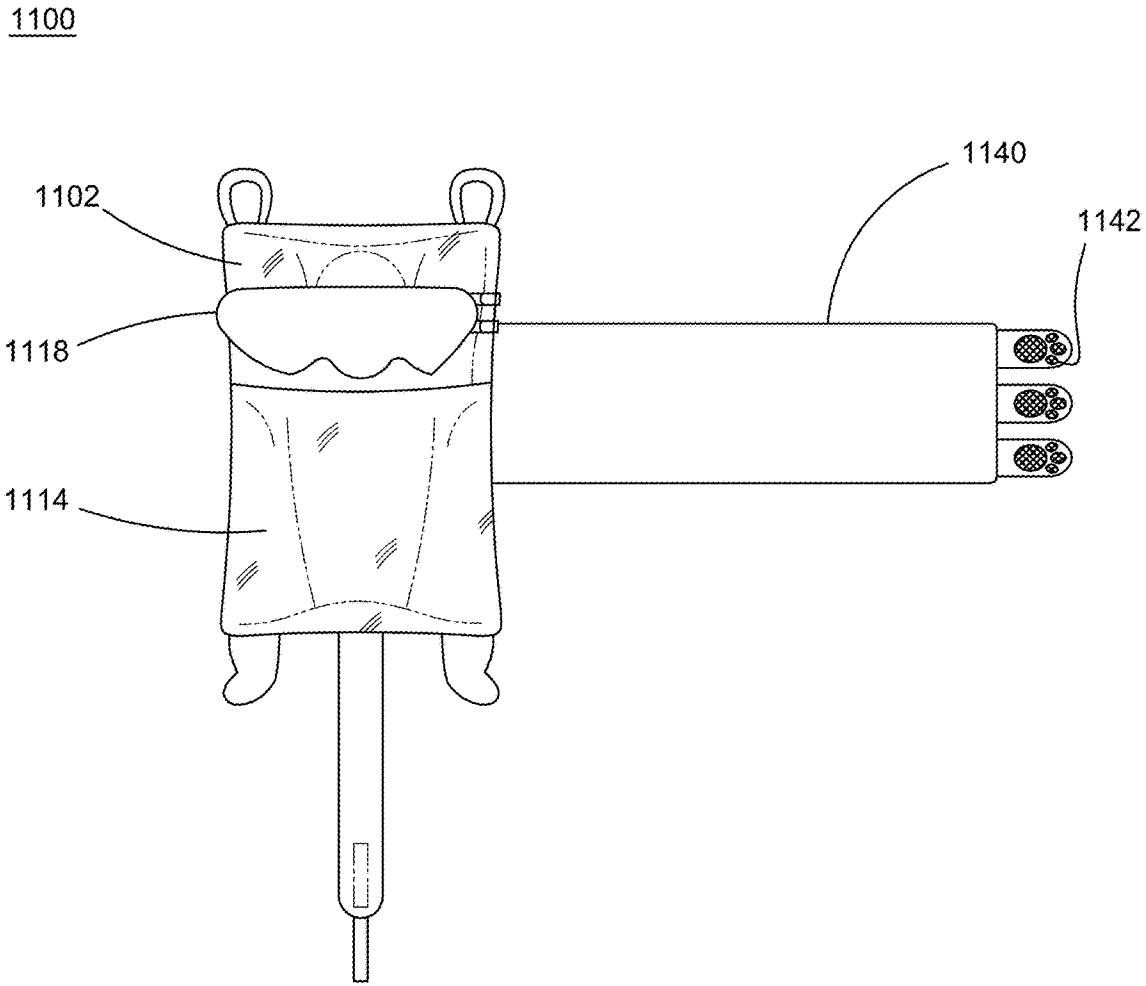
FIG. 14 shows a front view of a swaddle pillow with the pouch open, and including an attached swaddle, with a wrap being applied, in accordance with some embodiments.
Figure 16:
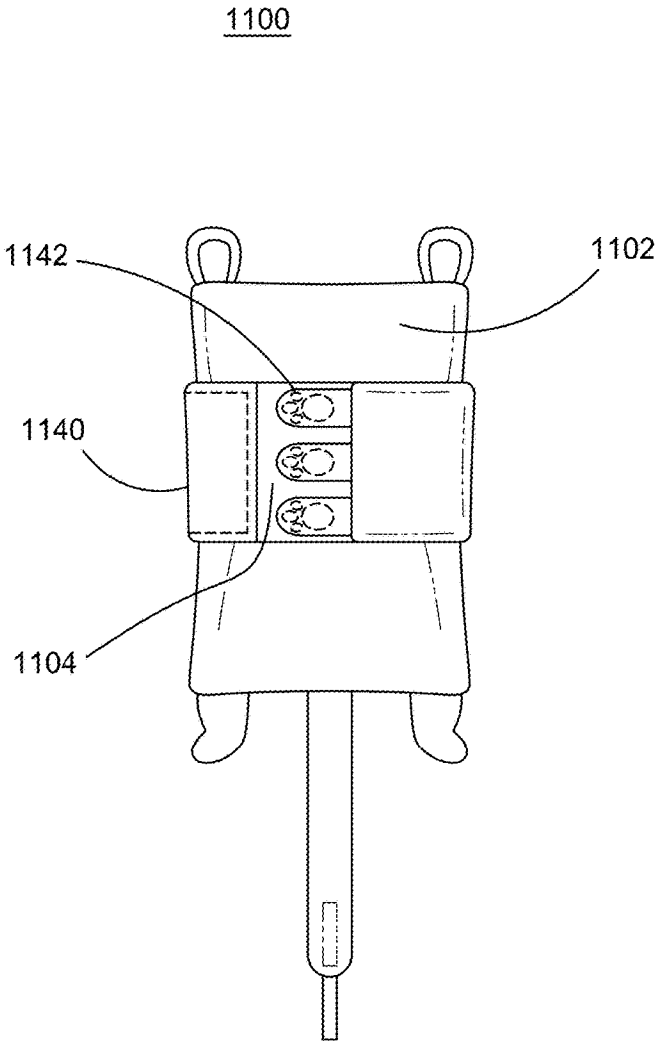
FIG. 16 shows a rear view of a swaddle pillow with a wrap in place around the swaddle pillow, in accordance with some embodiments.
Figure 15:
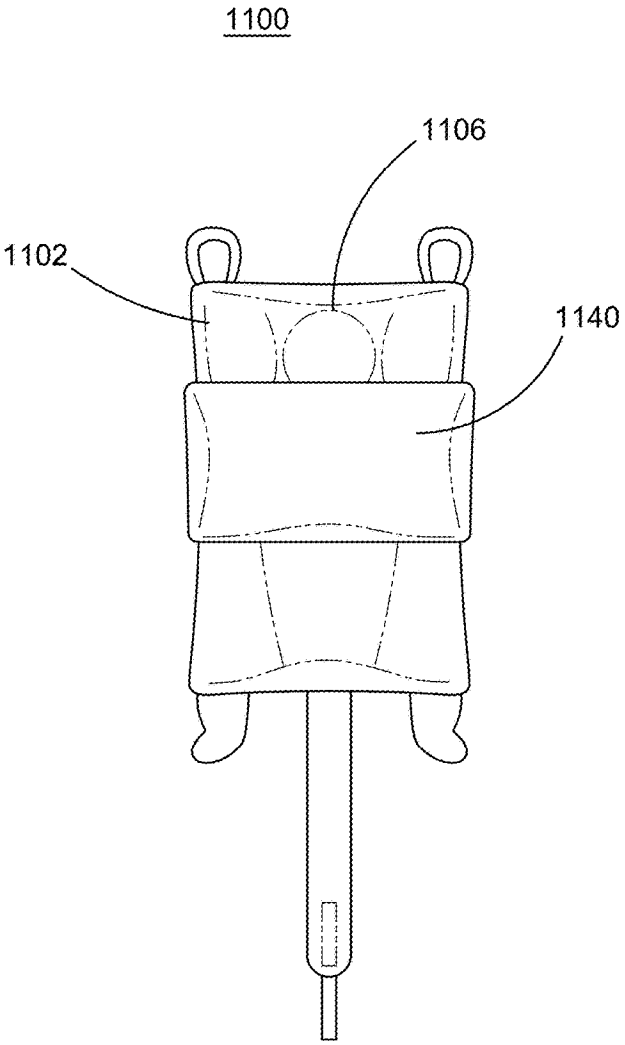
FIG. 15 shows a front view of a swaddle pillow with a wrap in place around the swaddle pillow, in accordance with some embodiments.

In FIGS. 13-14 there is an inner swaddle pouch 1118 that can be provided. The inner swaddle pouch is configured to swaddle the infant, particularly when the infant is smaller. The inner swaddle pouch 1118 includes a pouch body 1128, in which the infant's legs and torso are placed. There are flaps 1129 that can wrap around the infant's shoulders and torso, and closure features 1136 to hold the Raps 1129 closed (e.g. buttons, hook and loop fasteners). The inner swaddle pouch 1118 can be sewn to the case 1102, such as by stitching 1120, and it positions the infant so that the infant's head is positioned in the head depression 1006 and the body of the infant in the body depression 1008. FIG. 14 shows the pillow with the inner swaddle pouch 1118 and the flap 1114 closed. Further, an elastic comfort strap 1140 is shown. The comfort strap is attached at the back of the pillow 1100 at the hook and loop material 1104, and is therefore removable. As shown in FIGS. 15-16, the strap 1140 can wrap around the pillow 1100, such that complementary hook and loop material on the fingers 1142 at the free end of the strap can also attach to material 1104. This provides additional support for the infant. The inventive swaddle pillow provides several benefits over existing swaddle systems. For one, there isn't an excess of material present that could if not properly controlled, come to rest over the infant's face, possible obstructing breathing. The disclosed swaddle pillow also provides a complete surround of compressive force by use of the swaddle strap(s). This urges the sides of the pillow body inward, and at the same time there is compressive force at the front and back of the pillow body.

The disclosed swaddle pillow provides the benefit of easily swaddling a newborn infant, and during the period the infant is growing. The structure of the swaddle pillow also ensure consistency of the swaddling, so that the parent or caretaker is more easily able to ensure that the infant is properly swaddled.

The claims appended hereto are meant to cover all modifications and changes within the scope and spirit of the present invention.

What is claimed is:

1. A swaddle pillow, comprising:

a pillow body having a head end and a foot end;

a depression formed in the pillow body that starts adjacent the head end and extends towards the foot end, wherein the depression, adjacent the head end, is sized to receive a head of an infant;

a cover that extends over a torso portion of the pillow body and forms a pouch; and at least one elastic swaddle strap having a fixed end that is connected to the cover at a side of the swaddle pillow.

2. The swaddle pillow of claim 1, wherein the cover is attached to a front of the pillow body.

3. The swaddle pillow of claim 1, wherein the cover is a pouch cover, and wherein the torso portion of the pillow body fits within a pouch opening of the pouch cover.

4. The swaddle pillow of claim 1, wherein the at least one elastic swaddle strap further comprises a free end, and there is a section of hook and loop fastening material disposed at the free end, and there is a mating section of hook and loop fastening material at the fixed end, and at least one elastic swaddling strap is configured to wrap around an entirety of the swaddle pillow such that the section of hook and loop fastening material disposed at the free end mates with the mating section of hook and loop fastening material at the fixed end.

5. The swaddle pillow of claim 1, wherein the depression extends to the foot end of the pillow body.

6. The swaddle pillow of claim 1, wherein the swaddle pillow further comprises decoration that includes a simulated animal tail, wherein an end of the simulated animal tail is configured to hold a pacifier.

7. The swaddle pillow of claim 1, wherein the pillow body around the depression, is a consistent thickness from a front of the pillow body to a back of the pillow body.

8. The swaddle pillow of claim 7, wherein the depression extends to a position adjacent the foot end of the pillow body, and wherein the depression widens, from a head section to a torso section, to accommodate a shoulder area of the infant.

9. The swaddle pillow of claim 1, wherein a head portion of the depression of the pillow body is thicker, from a front of the pillow body to a back of the pillow body, than a torso portion of the depression, and wherein the head portion and the torso portion are separated by a raised neck area.

10. A swaddle pillow for an infant, comprising: a pillow body having a head end and a body portion adjacent the head end centrally along a length of the pillow; a head depression formed in the pillow body at the head end; a body depression formed in the pillow body along the body portion; a case configured to fit over the pillow body; a flap attached at an end of the case which forms a pouch over the body portion when the flap is folded over the pillow body and an inner swaddle pouch having a pouch body positioned over the body depression, and flaps that are configured to wrap around the shoulders and torso of the infant when the infant is positioned in the inner swaddle pouch.

11. The swaddle pillow of claim 10, further comprising at least one elastic strap configured to wrap around the body portion.

12. The swaddle pillow of claim 11, wherein the case includes a portion of hook and loop material at a back of the swaddle pillow, and when the case is on the pillow body, that portion of hook and loop material on the case mates with a complementary portion of hook and loop material at an end of the at least one elastic strap.

13. The swaddle pillow of claim 10, further including a tail configured to couple to the case, and including a strap at a free end of the tail that is configured to form a loop.

14. The swaddle pillow of claim 10, wherein the head depression and the body depression are formed by stitching in the pillow body.

15. The swaddle pillow of claim 10, wherein the head depression and the body depression are separated by a raised neck area.

16. The swaddle pillow of claim 10, wherein the head depression and the body depression are jointly surrounded by a raised border of the pillow body.

17. The swaddle pillow of claim 16 wherein the raised border entirely surrounds the head depression and the body depression.

* * * * *